US010044109B2

(12) United States Patent
Cheng et al.

(10) Patent No.: US 10,044,109 B2
(45) Date of Patent: Aug. 7, 2018

(54) MULTI-POLARIZATION SUBSTRATE INTEGRATED WAVEGUIDE ANTENNA

(71) Applicant: Huawei Technologies Co., Ltd., Shenzhen, Guangdong (CN)

(72) Inventors: Yujian Cheng, Chengdu (CN); Yi Chen, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 12 days.

(21) Appl. No.: 15/299,726

(22) Filed: Oct. 21, 2016

(65) Prior Publication Data

US 2017/0040703 A1 Feb. 9, 2017

Related U.S. Application Data

(63) Continuation of application No. PCT/CN2014/075945, filed on Apr. 22, 2014.

(51) Int. Cl.
*H01Q 13/02* (2006.01)
*H01Q 1/38* (2006.01)
(Continued)

(52) U.S. Cl.
CPC ..... *H01Q 13/02* (2013.01); *H01Q 1/38* (2013.01); *H01Q 1/422* (2013.01); *H01Q 9/045* (2013.01); *H01Q 13/106* (2013.01); *H01Q 21/24* (2013.01)

(58) Field of Classification Search
CPC ..... H01Q 13/02; H01Q 1/38; H01Q 9/045; H01Q 1/422; H01Q 21/24
See application file for complete search history.

(56) References Cited

U.S. PATENT DOCUMENTS 6,054,953 A 4/2000 Lindmark
2011/0018657 A1* 1/2011 Cheng ..... H01P 3/121 333/239
2011/0248890 A1 10/2011 Lee et al.

FOREIGN PATENT DOCUMENTS

CN 1300453 A 6/2001
CN 101183743 A 5/2008
(Continued)

OTHER PUBLICATIONS

Cheng, et al., "Vertically Intergrated Three-Pole Filter/Antennas for Array Applications," IEEE Antennas and Wireless Propagation Letters, vol. 10, 2011, pp. 278-281.
(Continued)

*Primary Examiner* — Dameon E Levi
*Assistant Examiner* — David Lotter

(57) ABSTRACT

Embodiments of the present invention provide a multi-polarization substrate integrated waveguide antenna. In the multi-polarization substrate integrated waveguide antenna of the present invention, the antenna is of a multi-layer structure and includes a first metal copper clad layer, a first dielectric layer, a second metal copper, clad layer, a second dielectric layer, and a third metal copper clad layer successively from top to bottom, where plated through holes are provided on both the first dielectric layer and the second dielectric layer, and etching grooves are provided on both the first metal copper clad layer and the second metal copper clad layer. The embodiments of the present invention resolve a problem that feeding efficiency is reduced in a high frequency application when a microstrip is used to feed electricity.

8 Claims, 2 Drawing Sheets

(51) Int. Cl.

| | |
|---|---|
| ***H01Q 9/04*** | (2006.01) |
| ***H01Q 13/10*** | (2006.01) |
| ***H01Q 1/42*** | (2006.01) |
| ***H01Q 21/24*** | (2006.01) |

(56) References Cited

FOREIGN PATENT DOCUMENTS

| | | | |
|---|---|---|---|
| CN | 101242027 | A | 8/2008 |
| CN | 101320846 | A | 12/2008 |
| CN | 103268985 | A | 8/2013 |
| CN | 103311653 | A | 9/2013 |
| CN | 103390784 | A | 11/2013 |
| CN | 103515682 | A | 1/2014 |
| CN | 103594779 | A | 2/2014 |
| JP | 10303612 | | 11/1998 |

OTHER PUBLICATIONS

Cheng, et al., "W-Band Large-Scale High-Gain Planar Integrated Antenna Array," IEEE Transactions on Antennas and Propagation, vol. 62, No. 6, Jun. 2014, pp. 3370-3373.

Cheng, et al., "60-GHz LTCC Miniaturized Substrate Integrated Multibeam Array Antenna with Multiple Polarizations," IEEE Transactions on Antennas and Propagation, vol. 61, No. 12, Dec. 2013, pp. 5958-5967.

Mbaye, et al., "Bandwidth Broadening of Dual-Slot Antenna Using Substrate Integrated Waveguide (SIW)," IEEE Antennas and Wireless Propagation Letters, vol. 12, 2013, pp. 1169-1171.

Yusuf, et al., "A Seamless Integration of 3-D Vertical Filters with Highly Efficient Slot Antennas," IEEE Transactions on Antennas and Propagation, vol. 59, No. 11, Nov. 2011, pp. 4016-4022.

* cited by examiner

MULTI-POLARIZATION SUBSTRATE INTEGRATED WAVEGUIDE ANTENNA

CROSS-REFERENCE TO RELATED APPLICATIONS

This application is a continuation of International Application No. PCT/CN2014/075945, filed on Apr. 22, 2014, the disclosure of which is hereby incorporated by reference in its entirety.

TECHNICAL FIELD

Embodiments of the present invention relate to communications technologies, and in particular, to a multi-polarization substrate integrated waveguide antenna.

BACKGROUND

In various wireless communications and radar systems, information transmitting and receiving both depend on antennas. With the rapid development of large-capacity, multifunctional, and ultra-wideband integrated information systems, a quantity of information carried on a same platform greatly increases, and a quantity of required antennas also increases correspondingly. This is contradictory to the trend of development that requires the antenna to reduce total costs of the integrated information system, reduce a weight, reduce a scattering cross-section of radar on the platform, implement a good electromagnetic compatibility feature, and the like. The emergence of a multi-polarization antenna can effectively resolve this contradiction, and the multi-polarization antenna can dynamically change a working polarization mode of the multi-polarization antenna according to a requirement of an actual application, so as to provide a polarization diversity to resolve multi-path fading and increase a channel capacity.

An existing directional coupled feeding low-profile back cavity round polarization antenna (patent CN200710156825.2) needs to use a microstrip to feed electricity due to a circuit structure and a size; as a result, feeding efficiency is reduced in a high frequency application.

SUMMARY

Embodiments of the present invention provide a multi-polarization substrate integrated waveguide antenna, so as to resolve a problem that feeding efficiency is reduced in a high frequency application when a microstrip is used to feed electricity.

According to a first aspect, an embodiment of the present invention provides a multi-polarization substrate integrated waveguide antenna, where the antenna is of a multi-layer structure and includes a first metal copper clad layer, a first dielectric layer, a second metal copper clad layer, a second dielectric layer, and a third metal copper clad layer successively from top to bottom, where plated through holes are provided on both the first dielectric layer and the second dielectric layer, and etching grooves are provided on both the first metal copper clad layer and the second metal copper clad layer.

With reference to the first aspect, in a first possible implementation manner of the first aspect, two parallel columns of first plated through holes are provided on the first dielectric layer, and the two columns of first plated through holes connect the first metal copper clad layer to the second metal copper clad layer to form a first dielectric waveguide in the first dielectric layer; and one row of second plated through holes are formed on the first dielectric layer, and the column of second plated through holes are perpendicular to both the two columns of first plated through holes and are close to one end of the two columns of first plated through holes to form a first short circuit surface in the first dielectric layer; and two parallel columns of third plated through holes are provided on the second dielectric layer, and the two columns of third plated through holes connect the second metal copper clad layer to the third metal copper clad layer to form a second dielectric waveguide in the second dielectric layer; and one row of fourth plated through holes are formed on the second dielectric layer, and the column of fourth plated through holes are perpendicular to both the two columns of third plated through holes and are close to one end of the two columns of third plated through holes to form a second short circuit surface in the second dielectric layer.

With reference to the first possible implementation manner of the first aspect, in a second possible implementation manner of the first aspect, in a vertical direction, a first center line between the two columns of first plated through holes does not coincide with a second center line between the two columns of third plated through holes.

With reference to the second possible implementation manner of the first aspect, in a third possible implementation manner of the first aspect, a first longitudinal etching groove and a transverse etching groove are etched on the first metal copper clad layer; the first longitudinal etching groove is perpendicular to the first short circuit surface, and the first longitudinal etching groove is located on a vertical projection of the first center line on the first metal copper clad layer; and the transverse etching groove is parallel to the first short circuit surface; and a second longitudinal etching groove is etched on the second metal copper clad layer; and the second longitudinal etching groove is perpendicular to the second short circuit surface, and the second longitudinal etching groove coincides with a vertical projection of the first longitudinal etching groove on the second metal copper clad layer.

With reference to the third possible implementation manner of the first aspect, in a fourth possible implementation manner of the first aspect, a length of the first longitudinal etching groove, a length of the second longitudinal etching groove, and a distance between a midpoint of the second longitudinal etching groove and a vertical projection of the second short circuit surface on the second metal copper clad layer are adjusted to control a working frequency in a first polarization state; and a distance between the transverse etching groove and a vertical projection of the first short circuit surface on the first metal copper clad layer is adjusted to control a working frequency in a second polarization state.

With reference to the third or fourth possible implementation manner of the first aspect, in a fifth possible implementation manner of the first aspect, the length of the first longitudinal etching groove, the length of the second longitudinal etching groove, and a length of the transverse etching groove are a half of a waveguide wavelength of the first dielectric waveguide;

the distance between the transverse etching groove and the vertical projection of the first short circuit surface on the first metal copper clad layer is a half of the waveguide wavelength of the first dielectric waveguide; and the distance between the midpoint of the second longitudinal etching groove and the vertical projection of the second short circuit surface on the second metal copper clad layer is a quarter of the waveguide wavelength of the second dielectric waveguide.

With reference to any one of the first aspect and the first to fifth possible implementation manners of the first aspect, in a sixth possible implementation manner of the first aspect, a 90 degree coupler is connected to input ports of the first dielectric waveguide and the second dielectric waveguide to implement a dual circular polarization working mode.

With reference to any one of the third to fifth possible implementation manners of the first aspect, in a seventh possible implementation manner of the first aspect, a third dielectric layer and a fourth metal copper clad layer are covered on the first metal copper clad layer successively from bottom to top, and a patch antenna or a radiating element is printed on the fourth metal copper clad layer to feed electricity by using the first longitudinal etching groove and the transverse etching groove.

In the embodiments of the present invention, the multi-polarization substrate integrated waveguide antenna uses a substrate integrated waveguide structure, thereby implementing a dual linear polarization working mode with a same frequency or a dual band, having a good polarization isolation degree, and effectively resolving a problem that feeding efficiency is reduced in a high frequency application when a microstrip is used to feed electricity.

BRIEF DESCRIPTION OF THE DRAWINGS

To describe the technical solutions in the embodiments of the present invention or in the prior art more clearly, the following briefly introduces the accompanying drawings required for describing the embodiments or the prior art. Apparently, the accompanying drawings in the following description show some embodiments of the present invention, and persons of ordinary skill in the art may still derive other drawings from these accompanying drawings without creative efforts.

DETAILED DESCRIPTION

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are some but not all of the embodiments of the present invention. All other embodiments obtained by persons of ordinary skill in the art based on the embodiments of the present invention without creative efforts shall fall within the protection scope of the present invention.

Figure 1:
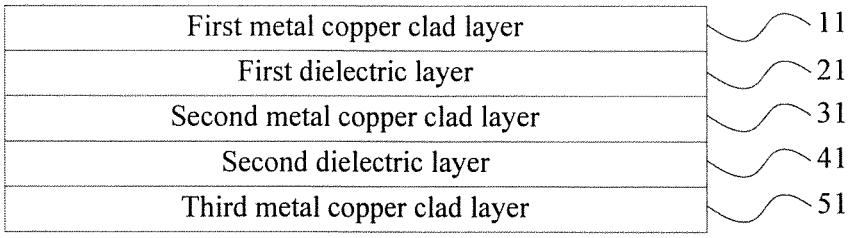
FIG. 1 is a schematic structural diagram of Embodiment 1 of a multi-polarization substrate integrated waveguide antenna according to the present invention.

FIG. 1 is a schematic structural diagram of Embodiment 1 of a multi-polarization substrate integrated waveguide antenna according to the present invention. As shown in FIG. 1, the multi-polarization substrate integrated waveguide antenna is of a multi-layer structure and includes a first metal copper clad layer 11, a first dielectric layer 21, a second metal copper clad layer 31, a second dielectric layer 41, and a third metal copper clad layer 51 successively from top to bottom, where plated through holes are provided on both the first dielectric layer 21 and the second dielectric layer 41, and etching grooves are disposed on both the first metal copper clad layer 11 and the second metal copper clad layer 31.

In the antenna in this embodiment, when a first dielectric waveguide feeds electricity, an electromagnetic wave is radiated out transversely from the first metal copper clad layer 11. When a second dielectric waveguide feeds electricity, an electromagnetic wave is radiated out longitudinally from the first metal copper clad layer 11 to control a polarization state of the antenna. In addition, working frequencies in different polarization states may be the same or may be different, which is not specifically limited herein.

In this embodiment, a multi-polarization substrate integrated waveguide structure is used, thereby implementing a dual linear polarization working mode with a same frequency or a dual band, having a good polarization isolation degree, and effectively resolving a problem that feeding efficiency is reduced in a high frequency application when a microstrip is used to feed electricity.

Figure 2:
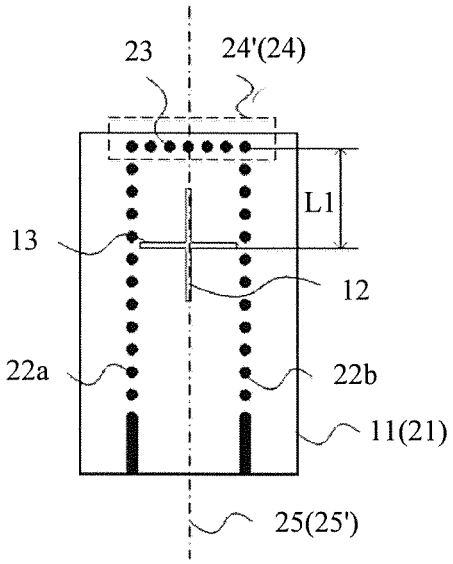
FIG. 2 is a top perspective view of a first metal copper clad layer and a first dielectric layer in Embodiment 2 of a multi-polarization substrate integrated waveguide antenna according to the present invention.
Figure 3:
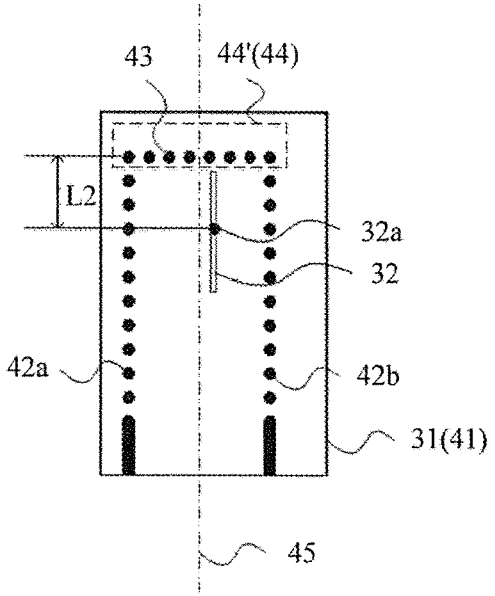
FIG. 3 is a top perspective view of a second metal copper clad layer and a second dielectric layer in Embodiment 2 of the multi-polarization substrate integrated waveguide antenna according to the present invention.

FIG. 2 is a top perspective view of a first metal copper clad layer and a first dielectric layer in Embodiment 2 of a multi-polarization substrate integrated waveguide antenna according to the present invention, and FIG. 3 is a top perspective view of a second metal copper clad layer and a second dielectric layer in Embodiment 2 of the multi-polarization substrate integrated waveguide antenna according to the present invention. With reference to FIG. 2 and FIG. 3, two parallel columns of first plated through holes 22*a* and 22*b* are formed on the first dielectric layer 21, and the two columns of first plated through holes 22*a* and 22*b* connect the first metal copper clad layer 11 to the second metal copper clad layer 31 to form a first dielectric waveguide in the first dielectric layer 21; and one row of second plated through holes 23 are formed on the first dielectric layer 21, and the second plated through holes 23 are perpendicular to both the two columns of first plated through holes 22*a* and 22*b* and are close to one end of the two columns of first plated through holes 22*a* and 22*b* to form a first short circuit surface 24 in the first dielectric layer 21.

Two parallel columns of third plated through holes 42*a* and 42*b* are formed on the second dielectric layer 41, and the two columns of third plated through holes 42*a* and 42*b* connect the second metal copper clad layer 31 to the third metal copper clad layer 51 to form a second dielectric waveguide in the second dielectric layer 41; and one row of fourth plated through holes 43 are formed on the second dielectric layer 41, and the fourth plated through holes 43 are perpendicular to both the two columns of third plated through holes 42*a* and 42*b* and are close to one end of the two columns of third plated through holes 42*a* and 42*b* to form a second short circuit surface 44 in the second dielectric layer 41.

In a vertical direction, a first center line 25 between the two columns of first plated through holes 22*a* and 22*b* does not coincide with a second center line 45 between the two columns of third plated through holes 42*a* and 42*b*.

A first longitudinal etching groove 12 and a transverse etching groove 13 are etched on the first metal copper clad layer 11; the first longitudinal etching groove 12 is perpendicular to the first short circuit surface 24, and the first longitudinal etching groove 12 is located on a vertical projection 25' of the first center line 25 on the first metal copper clad layer 11; and the transverse etching groove 13 is parallel to the first short circuit surface 24.

A second longitudinal etching groove 32 is etched on the second metal copper clad layer 31; and the second longitudinal etching groove 32 is perpendicular to the second short circuit surface 44, and the second longitudinal etching groove 32 coincides with a vertical projection 12' of the first longitudinal etching groove 12 on the second metal copper clad layer 31.

A length of the first longitudinal etching groove 12, a length of the second longitudinal etching groove 32, and a distance L2 between a midpoint 32*a* of the second longitudinal etching groove 32 and a vertical projection 44' of the second short circuit surface 44 on the second metal copper clad layer 31 are adjusted to control a working frequency in a first polarization state; and a distance L1 between the transverse etching groove 13 and a vertical projection 24' of the first short circuit surface 24 on the first metal copper clad layer 11 is adjusted to control a working frequency in a second polarization state.

In the antenna in this embodiment, when the first dielectric waveguide feeds electricity, the second longitudinal etching groove 32 on the second metal copper clad layer 31 coincides with the vertical projection 12' of the first longitudinal etching groove 12 on the second metal copper clad layer 31, and the first longitudinal etching groove 12 is located on the vertical projection 25' of the first center line 25 on the first metal copper clad layer 11. Therefore, the second longitudinal etching groove 32 is exactly located on a vertical projection of the first center line 25 on the second metal copper clad layer 31, the second longitudinal etching groove 32 coincides with the first center line 25 in the vertical direction and the two are perfectly isolated from each other, so that energy cannot enter the second dielectric waveguide through the second longitudinal etching groove 32. In addition, the first longitudinal etching groove 12 on the first metal copper clad layer 11 is also located on the vertical projection 25' of the first center line 25 on the first metal copper clad layer 11; therefore, the first longitudinal etching groove 12 cannot radiate energy. In this case, an electromagnetic wave is radiated out only from the transverse etching groove 13 on the first metal copper clad layer 11. When the second dielectric waveguide feeds electricity, the second longitudinal etching groove 32 on the second metal copper clad layer 31 cuts a surface current, energy is coupled to enter the first dielectric waveguide and radiated out from the first longitudinal etching groove 12 on the first metal copper clad layer 11. In this case, the transverse etching groove 13 has no radiation function. A polarization state of the antenna can be controlled by using the foregoing method, and the working frequency in the first polarization state and the working frequency in the second polarization state may be the same or may be different, which is not specifically limited herein.

In this embodiment, a multi-polarization substrate integrated waveguide structure is used, thereby implementing a dual linear polarization working mode with a same frequency or a dual band, having a good polarization isolation degree, and effectively resolving a problem that feeding efficiency is reduced in a high frequency application when a microstrip is used to feed electricity.

Further, the length of the first longitudinal etching groove 12, the length of the second longitudinal etching groove 32, and length of the transverse etching groove 13 are a half of waveguide wavelength of the first dielectric waveguide; the distance L1 between the transverse etching groove 13 and the vertical projection 24' of the first short circuit surface 24 on the first metal copper clad layer 11 is a half of the waveguide wavelength of the first dielectric waveguide; and the distance L2 between the midpoint 32*a* of the second longitudinal etching groove 32 and the vertical projection 44' of the second short circuit surface 44 on the second metal copper clad layer 31 is a quarter of the waveguide wavelength of the second dielectric waveguide.

Specifically, the length of the first longitudinal etching groove 12, the length of the second longitudinal etching groove 32, and the length of the transverse etching groove 13 are related to the waveguide wavelength of the first dielectric waveguide, and after these lengths are determined, a corresponding waveguide wavelength of the first dielectric waveguide can be obtained, or it may be that if a specific waveguide wavelength of the first dielectric waveguide is expected, the length of the first longitudinal etching groove 12, the length of the second longitudinal etching groove 32, and the length of the transverse etching groove 13 are adjusted to corresponding lengths. The principle of determining the distance L1 between the transverse etching groove 13 and the vertical projection 24 of the first short circuit surface 24 on the first metal copper clad layer 11 and the distance L2 between the midpoint 32*a* of the second longitudinal etching groove 32 and the vertical projection 44' of the second short circuit surface 44 on the second metal copper clad layer 31 is the same as the foregoing principle.

Figure 4:
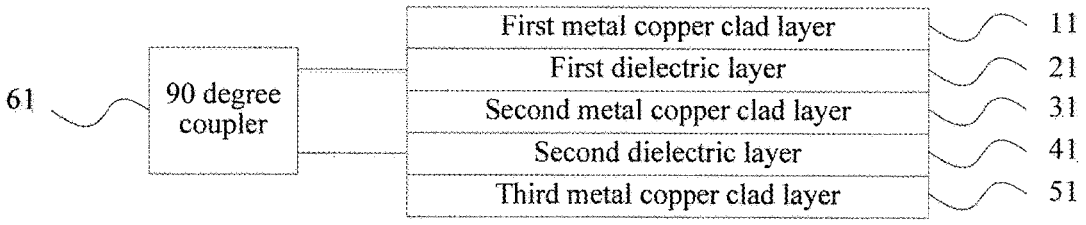
FIG. 4 is a schematic structural diagram of Embodiment 3 of a multi-polarization substrate integrated waveguide antenna according to the present invention.

FIG. 4 is a schematic structural diagram of Embodiment 3 of a multi-polarization substrate integrated waveguide antenna according to the present invention. As shown in FIG. 4, based on the apparatus structure shown in FIG. 1, an apparatus in this embodiment may further include a 90 degree coupler 61 to implement a dual circular polarization working mode of the antenna.

Figure 5:
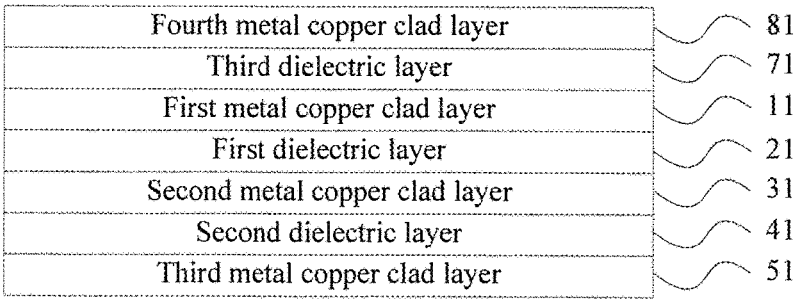
FIG. 5 is a schematic structural diagram of Embodiment 4 of a multi-polarization substrate integrated waveguide antenna according to the present invention.

FIG. 5 is a schematic structural diagram of Embodiment 4 of a multi-polarization substrate integrated waveguide antenna according to the present invention. As shown in FIG. 5, based on the apparatus structure shown in FIG. 1, in an apparatus in this embodiment, further, a third dielectric layer 71 and a fourth metal copper clad layer 81 are covered on the first metal copper clad layer 11 successively from bottom to top, and a patch antenna 82 or a radiating element 83 is printed on the fourth metal copper clad layer 81 to feed electricity by using the first longitudinal etching groove 12 and the transverse etching groove 13.

In the several embodiments provided in the present invention, it should be understood that the disclosed apparatus and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The foregoing integrated unit can be implemented in a form of hardware.

It may be clearly understood by persons skilled in the art that, for the purpose of convenient and brief description, division of the foregoing functional modules is taken as an example for illustration. In actual applications, the foregoing functions can be allocated to different functional modules and implemented according to a requirement, that is, an inner structure of an apparatus is divided into different functional modules to implement all or some of the functions described above. For a detailed working process of the foregoing apparatus, reference may be made to a corresponding process in the foregoing method embodiments, and details are not described herein again.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A multi-polarization substrate integrated waveguide antenna, wherein the antenna is of a multi-layer structure and comprises:

a first metal copper clad layer;

a first dielectric layer;

a second metal copper clad layer;

a second dielectric layer; and a third metal copper clad layer, successively from top to bottom; wherein:

plated through holes are provided on both the first dielectric layer and the second dielectric layer, and etching grooves are disposed on both the first metal copper clad layer and the second metal copper clad layer;

two parallel columns of first plated through holes are provided on the first dielectric layer, and the two columns of first plated through holes connect the first metal copper clad layer to the second metal copper clad layer to form a first dielectric waveguide in the first dielectric layer;

one row of second plated through holes is formed on the first dielectric layer, and the row of second plated through holes is perpendicular to both the two columns of first plated through holes and is close to one end of the two columns of first plated through holes to form a first short circuit surface in the first dielectric layer;

two parallel columns of third plated through holes are provided on the second dielectric layer, and the two columns of third plated through holes connect the second metal copper clad layer to the third metal copper clad layer to form a second dielectric waveguide in the second dielectric layer; and one row of fourth plated through holes is formed on the second dielectric layer, and the row of fourth plated through holes is perpendicular to both the two columns of third plated through holes and is close to one end of the two columns of third plated through holes to form a second short circuit surface in the second dielectric layer.

2. The antenna according to claim 1, wherein in a vertical direction, a first center line between the two columns of first plated through holes does not coincide with a second center line between the two columns of third plated through holes.

3. The antenna according to claim 2, wherein:

a first longitudinal etching groove and a transverse etching groove are etched on the first metal copper clad layer; wherein the first longitudinal etching groove is perpendicular to the first short circuit surface, the first longitudinal etching groove is located on a vertical projection of the first center line on the first metal copper clad layer, and the transverse etching groove is parallel to the first short circuit surface; and a second longitudinal etching groove is etched on the second metal copper clad layer, wherein the second longitudinal etching groove is perpendicular to the second short circuit surface, and the second longitudinal etching groove coincides with a vertical projection of the first longitudinal etching groove on the second metal copper clad layer.

4. The antenna according to claim 3, wherein a length of the first longitudinal etching groove, a length of the second longitudinal etching groove, and a distance between a midpoint of the second longitudinal etching groove and a vertical projection of the second short circuit surface on the second metal copper clad layer are adjusted to control a working frequency in a first polarization state; and a distance between the transverse etching groove and a vertical projection of the first short circuit surface on the first metal copper clad layer is adjusted to control a working frequency in a second polarization state.

5. The antenna according to claim 4, wherein the length of the first longitudinal etching groove, the length of the second longitudinal etching groove, and a length of the transverse etching groove each are a half of a waveguide wavelength of the first dielectric waveguide;

the distance between the transverse etching groove and the vertical projection of the first short circuit surface on the first metal copper clad layer is a half of the waveguide wavelength of the first dielectric waveguide; and the distance between the midpoint of the second longitudinal etching groove and the vertical projection of the second short circuit surface on the second metal copper clad layer is a quarter of the waveguide wavelength of the second dielectric waveguide.

6. The antenna according to claim 1, wherein a 90 degree coupler is connected to input ports of the first dielectric waveguide and the second dielectric waveguide to implement a dual circular polarization working mode.

7. The antenna according to claim 3, wherein a third dielectric layer and a fourth metal copper clad layer are covered on the first metal copper clad layer successively from bottom to top, and a patch antenna or a radiating element is printed on the fourth metal copper clad layer to feed electricity by using the first longitudinal etching groove and the transverse etching groove.

8. A multi-polarization substrate integrated waveguide antenna, comprising:

a first metal copper clad layer;

a first dielectric layer disposed below the first metal copper layer;

a second metal copper clad layer disposed below the first dielectric layer;

a second dielectric layer disposed below the second metal copper clad layer;

a third metal copper clad layer disposed below the second dielectric layer;

two parallel columns of first plated through holes disposed in the first dielectric layer for connecting the first metal copper clad layer to the second metal copper clad layer to form a first dielectric waveguide in the first dielectric layer;

a first row of second plated through holes disposed in the first dielectric layer and perpendicular to the two parallel columns of first plated through holes, wherein the first row of second plated through holes is positioned close to one end of the two parallel columns of first plated through holes to form a first short circuit surface in the first dielectric layer;

two parallel columns of third plated through holes disposed in the second dielectric layer for connecting the second metal copper clad layer to the third metal copper clad layer to form a second dielectric waveguide in the second dielectric layer; and a first row of fourth plated through holes disposed in the second dielectric layer and perpendicular to the two parallel columns of third plated through holes, wherein the first row of fourth plated through holes is positioned close to one end of the two parallel columns of third plated through holes to form a second short circuit surface in the second dielectric layer.

* * * * *